US006598683B1

(12) United States Patent
Ultimo, Sr. et al.

(10) Patent No.: US 6,598,683 B1
(45) Date of Patent: Jul. 29, 2003

(54) PORTABLE INJECTION-CASING DRIVER

(75) Inventors: Frank D. Ultimo, Sr., Dana Point, CA (US); Luis Enrique Hernandez, Upland, CA (US); Naepu Joseph Pak, Tustin, CA (US)

(73) Assignee: Ultimo Organization, Inc., Santa Ana, CA (US)

( * ) Notice: Subject to any disclaimer, the term of this patent is extended or adjusted under 35 U.S.C. 154(b) by 94 days.

(21) Appl. No.: 09/677,624

(22) Filed: Oct. 3, 2000

Related U.S. Application Data

(60) Provisional application No. 60/157,970, filed on Oct. 6, 1999.

(51) Int. Cl.[7] ..... E21B 4/06

(52) U.S. Cl. ..... 173/1; 173/185; 173/186

(58) Field of Search ..... 173/1, 29, 40, 173/44, 89, 147, 185, 186

(56) References Cited

U.S. PATENT DOCUMENTS

| | | | | |
|---|---|---|---|---|
| 3,012,619 A | * | 12/1961 | Farque | 173/140 |
| 3,520,374 A | * | 7/1970 | Ebert | 173/147 |
| 3,563,322 A | * | 2/1971 | Young et al. | 173/44 |
| 3,833,072 A | * | 9/1974 | Back | 173/105 |
| 3,917,005 A | * | 11/1975 | Cannon et al. | 173/147 |
| 4,124,081 A | * | 11/1978 | Deike | 173/147 |
| 4,401,161 A | | 8/1983 | Warren | |
| 4,544,040 A | * | 10/1985 | Sweeney | 173/147 |
| 4,697,959 A | | 10/1987 | Kinnan | |
| 4,732,510 A | | 3/1988 | Louis | |
| 5,040,927 A | | 8/1991 | Wickberg | |

OTHER PUBLICATIONS

Rhino Tool Company, Rhino Model PD–39 Air Operated Post Driver—Product Specification, 1997, pp. 1–2, Kewanee, IL USA.

Rhino Tool Company, Rhino Models PD–45, 55, 100, 140 Post Drivers—Product Specifications, 1997, pp. 1–2, Kewanee, IL USA.

* cited by examiner

*Primary Examiner*—Scott A. Smith
*Assistant Examiner*—Nathaniel Chukwurah
(74) *Attorney, Agent, or Firm*—Glenn R. Smith

(57) ABSTRACT

A driver tool provides an apparatus and method for installing shaft objects such as casing, pipes, poles, bars, rods, piles or tubes into the ground or other surrounding media. The driver tool has a steel tower on which is mounted a pneumatic or hydraulic hammer. The hammer is attached to a chain-driven mounting plate controlled by a hydraulic or air-driven motor so that the hammer slides in either direction along the tower. In a typical operating position, the tower is generally vertical to the ground and positioned over a shaft section so that the hammer can drive the shaft object into the ground at a manually controlled rate. The hammer and tower are mounted on a chassis having turf tires for rough terrain capability. In its transport position, the tool is positioned on its tires, with the tower generally horizontal to the ground. As a result, the driver tool can be easily moved and operated by one or two men and operated in limited access areas.

18 Claims, 10 Drawing Sheets

PORTABLE INJECTION-CASING DRIVER

This application claims the benefit of provisional patent application No. 60/157,970 entitled Portable Injection-Casing Driver, filed Oct. 6, 1999.

BACKGROUND OF THE INVENTION

Geological grouting is a versatile construction technique used in a variety of applications. Injection casing or piping is driven into the ground. Grout is then pumped under pressure through the above-ground end of the installed casing, out the underground end, and into the surrounding soil. The grout itself can be made from many different materials proportioned in a wide range of amounts depending on the specific grouting application. Cementitious grout, for example, is a mixture of hydraulic cement and water, with or without aggregates and with or without admixtures. Hydraulic cements react with water to form a hardened paste that maintains its strength and durability in water and also maintains its properties upon drying.

Grouting applications include slabjacking, mud jacking, subsealing and soil grouting. In slabjacking, pressure grouting is used to raise a depressed section of pavement or other concrete element by forcing a flowable grout under it. Subsealing is where a cement-grout mixture is pumped under pressure through a packer installed in an access hole drilled in a slab to fill voids and depressions under the slab and reduce damage caused by excessive pavement deflections. For soil densification, soil is grouted to increase its bearing capacity, provide radial densification, reduce or halt settlement, increase shear resistance to stabilize it against lateral movement, reduce waterflow, or increase the cohesive strength of friable ground prior to excavation. Soil grouting includes permeation grouting, where a thin grout is used to permeate the soil and fill pores and voids between soil particles; deep-soil mixing, where soil and injected grout are mixed together to make a soil-cement material in place; jet grouting, where a cement-and-water grout is injected under very high pressure to form a concrete-like column; and compaction grouting, described below.

Compaction grouting is a soil stabilization process where weak or compromised sub-soils are densified. This technique involves driving injection casing into the soil in five to eight foot sections until good refusal is achieved, usually when the casing reaches bedrock or bearing strata. Pressure grouting is then performed in vertical stages throughout the length of the casing hole. The vertical stages are created by extracting a section of casing a fixed length, typically one to three feet, and then pumping a quantity of stiff, sand-and-cement grout through the casings. An operator monitors an external pump stroke counter at the pump and a pressure gauge at a pump head attached to the casing end. The operator also records the pressures achieved and the quantity of grout injected at each stage. A fully extracted section of casing is removed between stages, the pump head is reattached, and the extraction and grouting sequence is repeated. The stiff grout does not permeate the soil but maintains a grouted mass, three feet or more in diameter. By displacing the soil and forming a bulblike or coluninlike form, the grout significantly increases the soil density at a radial distance of one to six feet or more from the soil-grout interface.

SUMMARY OF THE INVENTION

Typically, injection casings for compaction grouting applications are installed with a handheld pneumatic or hydraulic hammer. One end of a casing section is attached to the end of a previously installed casing section. A crewman then stands atop a platform, positions the hammer to the unattached end of the casing, activates the hammer and drives the entire casing assembly into the ground. These steps are repeated multiple times.

Such handheld hammering methods, however, are potentially hazardous, awkward and time consuming. The pneumatic and hydraulic hammers are heavy and difficult to lift and position on the unattached casing end, which may extend five feet or more above ground-level. The crewman holding the heavy hammer is always at risk of falling off of the platform. This operation requires a two-man crew, with one man repeatedly climbing onto and off-of the platform and the other man transferring the hammer to and from the man on the platform and assisting in assembling the casing sections.

One aspect of the portable injection-casing driver according to the present invention is a driver tool for hammering a shaft into a surrounding media comprising a base plate and a tower attached to and extending generally perpendicularly from the base plate. The tower has a first end away from the base plate and a second end near the base plate. A powered hammer is movable along the tower between the first and second ends so that the shaft can be positioned between the media and the hammer when the hammer is near the first end of the tower and so that the shaft can be driven by the hammer into the media as the hammer is actuated and moved toward the second end.

The driver tool may also comprise a motor and a mount retained by the tower so as to be movable along the tower. The hammer is attached to the mount and a link is installed between the tower first and second ends. The link is utilized to transfer mechanical energy from the motor to the mount so as to move the hammer. The link may comprise an upper sprocket near the first end, a lower sprocket near the second end, a reduction gear and a drive chain engaging the sprockets and the gear. The motor also engages the gear. In one embodiment, at least one of the sprockets has a spring-loaded tension adjuster configured to dampen mechanical force generated during operation of the hammer. In another embodiment, the reduction gear has a gear ratio in the range of 50:1 to 70:1. In a further embodiment, the base plate has an open-faced slot configured to accommodate the shaft and balance and stabilize the tool. In another embodiment, the tower has a height in the range of 94 inches to 116 inches.

In yet another embodiment, the driver tool further comprises a control assembly having a first portion to direct power to the motor in order to raise and lower the hammer, and a second portion to direct power to the hammer in order to actuate and de-actuate the hammer. The first portion and the second portion are independently operable and configured to allow an operator to simultaneously lower and actuate the hammer with one hand. The motor and the hammer may be powered by compressed air. In this embodiment, the first portion comprises a dual-port valve controlled by a first handle to direct compressed air through the motor. The second portion comprises a single-port value controlled by a second handle to direct compressed air to the hammer.

In still another embodiment, the driver tool further comprises a wheel assembly. The tool is movable between an operating position having the base plate positioned against the media and a transport position having the wheel assembly positioned against the media so as to provide manual portability for the tool. The wheel assembly may be offset from the media in the operating position so as to increase stability for the tool. The base plate may be offset from the media in the transport position so as to increase portability of the tool. The driver tool may also have a brace that is deployed in the operating position to enhance the stability of the tool. The brace is folded against the tool in the transport position to enhance the portability of the tool.

Another aspect of the present invention is a method of installing a shaft into a surrounding media comprising the steps of providing motorized movement of a powered hammer along a tower, stabilizing the tower generally perpendicularly to the media, positioning the shaft proximate the tower lengthwise between the hammer and the media, and driving the shaft with the hammer into the media. The stabilizing step may comprise the substeps of attaching the tower to a generally planar base plate so that the tower extends in a direction normal to the base plate, and placing a face of the base plate against the media. The positioning step may comprise the substeps of providing an open-faced slot in the base plate and locating the shaft within the slot. The driving step may comprise the substeps of raising the hammer along the tower and away from the media so as to enable a first end of the shaft to be positioned near the hammer and a second end of the shaft to be positioned against the media and positioning the hammer so as to contact the shaft with a bit installed in the hammer. Further substeps are actuating the hammer so as to repeatedly strike the shaft with the bit and lowering the hammer along the tower and toward the media during the actuating step so as to maintain contact between the bit and the shaft.

Yet another aspect of the present invention is a driver tool for installing a shaft into a media comprising a base means for supporting the tool and accommodating the shaft, a hammer means for repeatedly striking the shaft, and a tower means attached to the base means for movably retaining the hammer means. The driver tool may further comprise a motor and a positioning means actuated by the motor for moving the hammer means along the tower means. Also, the driver tool may comprise a control means for independently routing power to the hammer means and the motor. The driver tool may further comprise a transport means for manually moving the tool.

The driver tool of the present invention has many advantages over present methods of installing injection casings and other shaft media into the ground. Because the hammer is slidably mounted to a tower, it eliminates the need of an operator handling this heavy piece of equipment. The tower allows the hammer to be precisely positioned on a casing end several feet above ground-level, eliminating the need for an operator to stand on a platform, with the associated safety risks. Unlike heavy equipment used for driving shafts into the ground, the driver tool is compact for operation in limited access areas and can utilize relatively small shaft sections compared with heavy equipment. The mounted turf tires and the size and balance of the driver tool allow portability by one or two men.

DETAILED DESCRIPTION OF THE PREFERRED EMBODIMENTS

Figure 1A:
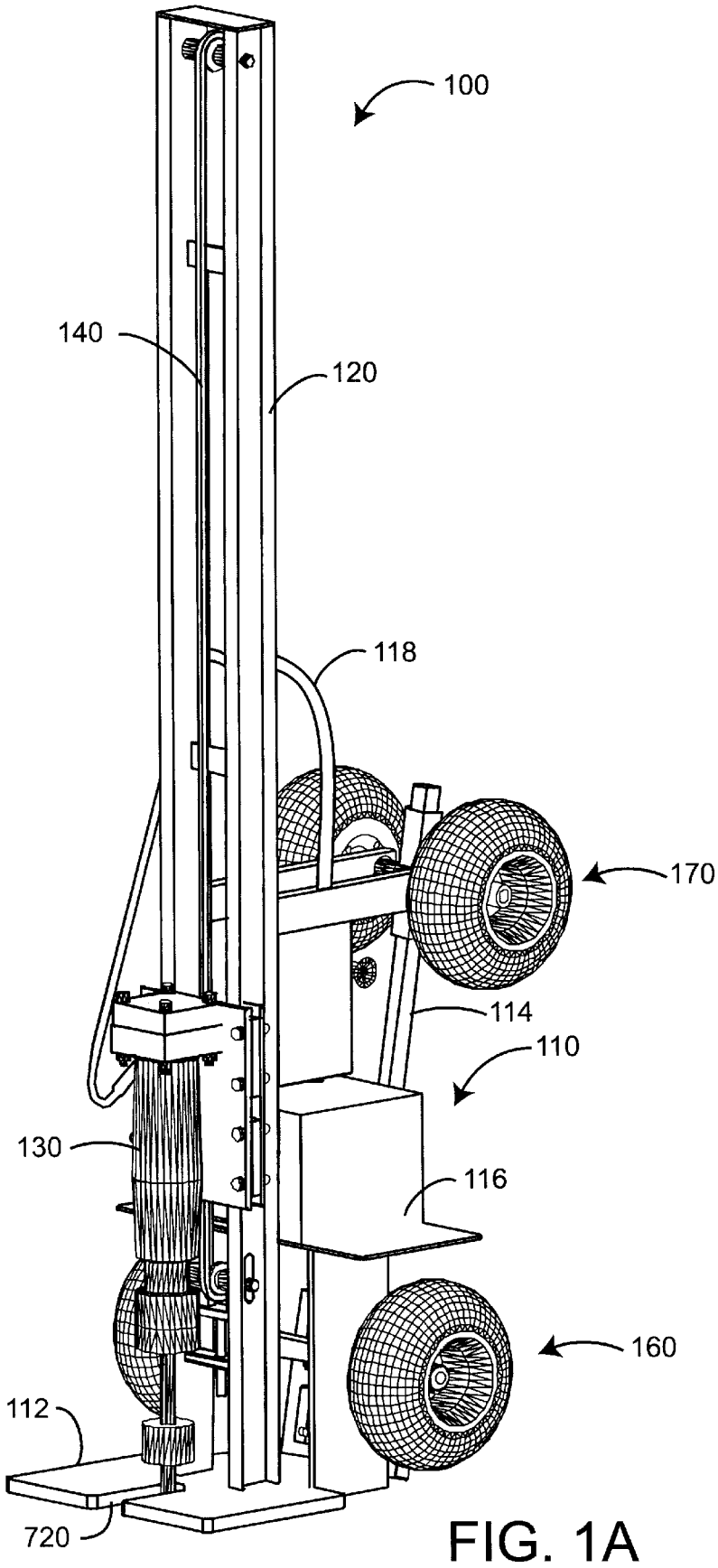
FIG. 1A is a front perspective view of the driver tool illustrating its operating position with the hammer lowered.
Figure 1B:
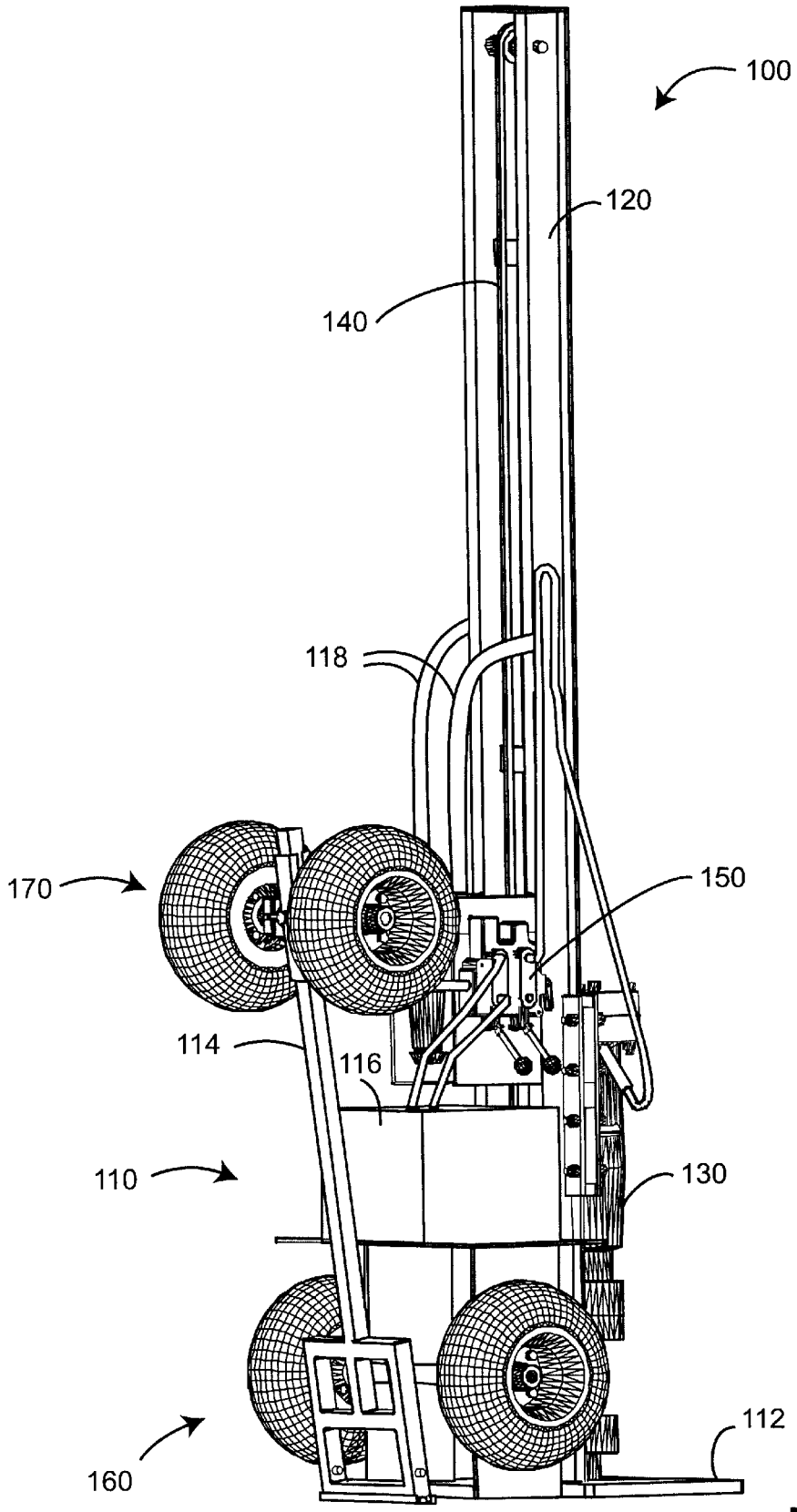
FIG. 1B is a rear perspective view of the driver tool corresponding to FIG 1A.

FIGS. 1A and 1B illustrate the operating position of the driver tool 100 according to the present invention. The driver tool 100 has a chassis 110, a tower 120, a hammer 130, a drive chain 140, a control assembly 150, a front wheel assembly 160 and a rear wheel assembly 170. The tower 120 is attached to the chassis 110 at several locations. The hammer 130 is mounted to the chain assembly 140, which moves the hammer up and down along the tower 120. The hammer 130 is shown lowered at its farthest extent along the tower 120. Hammer movement is accomplished with the chain assembly 140 at a direction and rate determined by a tool operator using the control assembly 150. The front 160 and rear 170 wheel assemblies are mounted on the chassis 110. In the tool's transport position (FIG. 3), the chassis 110 rests on the wheel assemblies 160, 170. In the tool's operating position, the wheel assemblies 160, 170 are not in contact with the ground, advantageously improving tool stability.

Figure 7A:
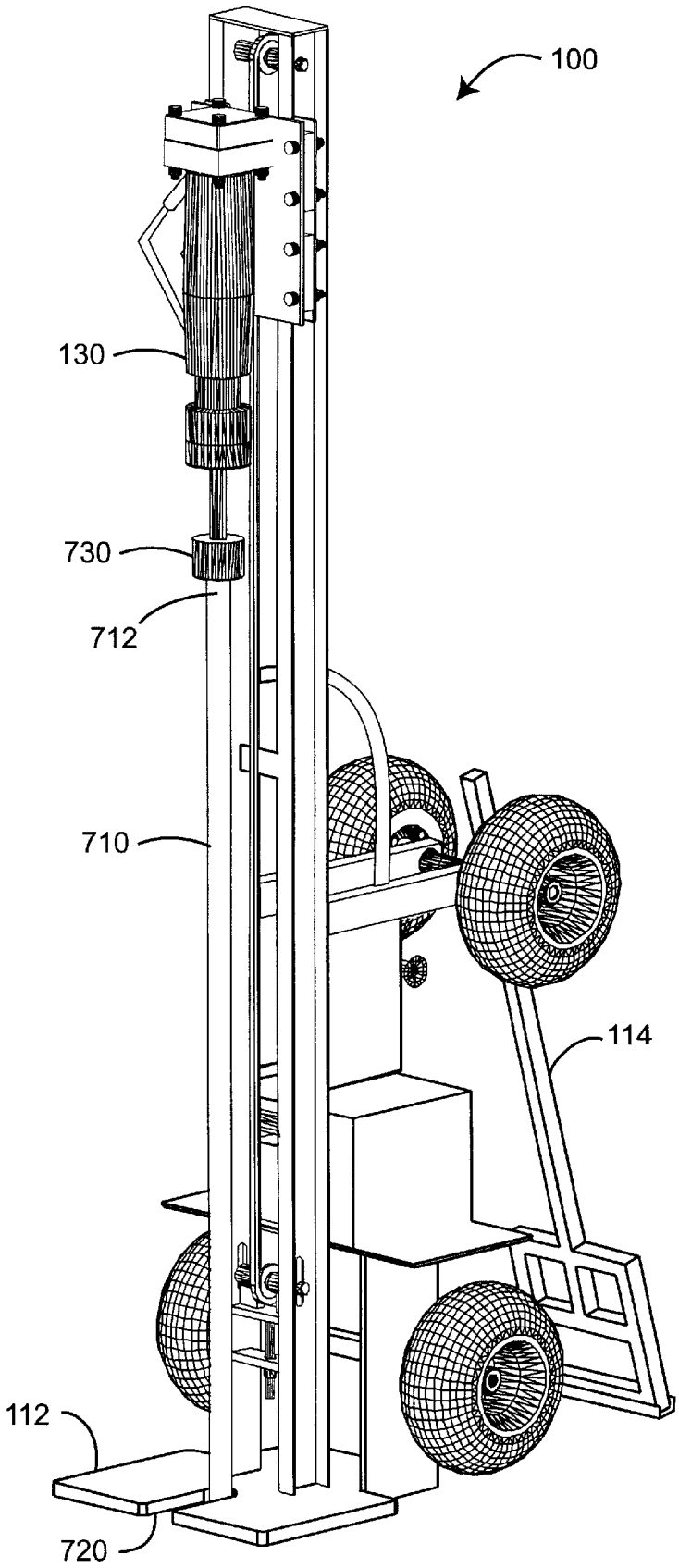
FIG. 7A is a front perspective view of the driver tool illustrating an injection casing positioned within the base plate and the hammer in a raised positioned with its bit loaded on the unattached end of an injection casing.
Figure 7B:
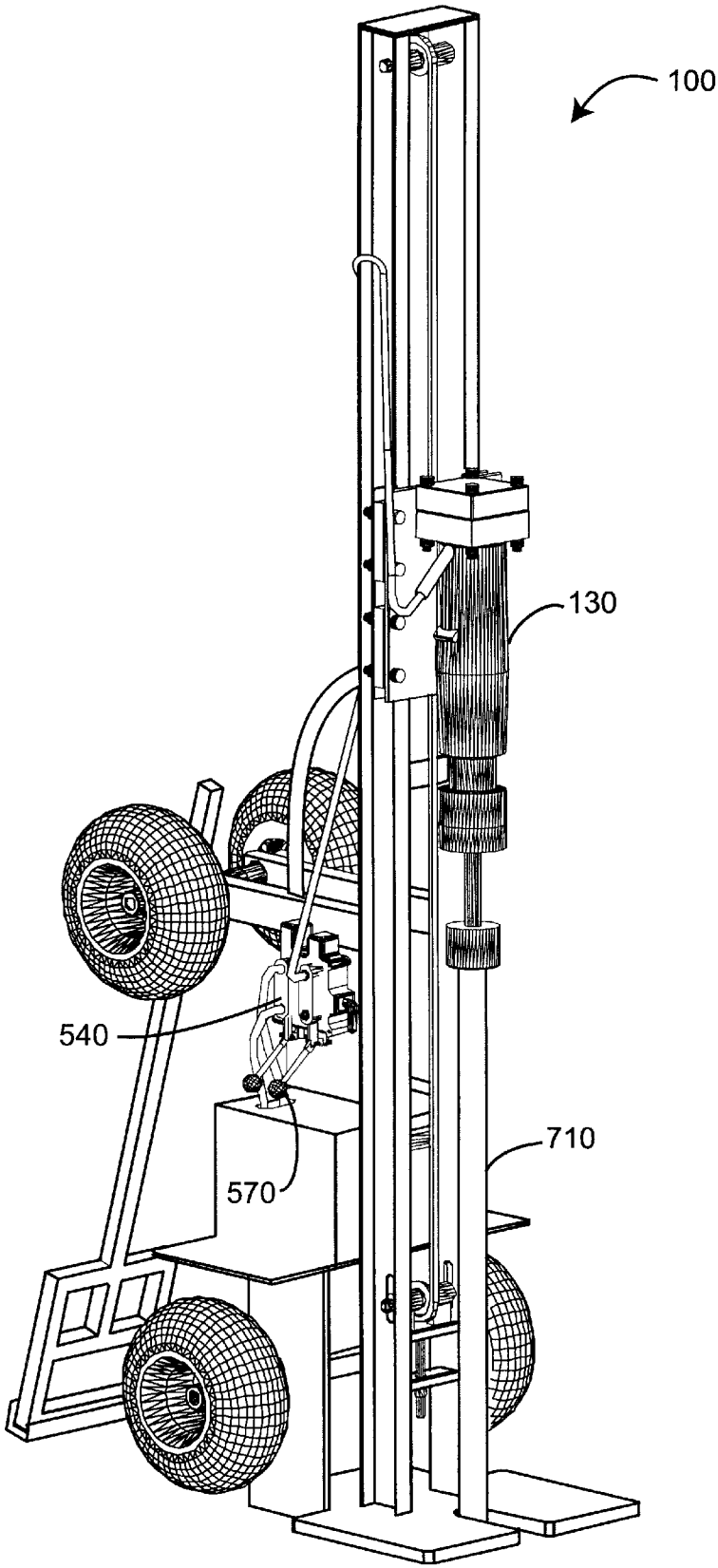
FIG. 7B is another front perspective view of the driver tool illustrating the hammer in a partially lowered position and the injection casing partially driven into its surrounding media during installation.

As shown in FIGS. 1A–1B, the chassis 110 has an open-face base plate 112, a retracting ground or floor brace 114, a motor box 116 and handles 118. The base plate 112 has an open-face slot 720 configured to accommodate injection casings during installation. When deployed, as shown in FIGS. 7A–B and described below, the brace 114 pivots away from the chassis and is positioned against the ground and locked in place to increase tool stability during operation. The motor box 116 contains a motor 410 (FIG. 4) that powers the drive chain 140. The handles 118 and balance of the tool 100 allow a person to move the tool 100 between its operating position and transport position without assistance. The handles 118 also allow one or two persons to easily move the tool 100 in its transport position.

In one embodiment, the tower 120 has a height in the range of between 94" and 116." A tower height at the low end of that range advantageously allows driver tool accessibility to confined spaces, such as inside a structure with 8' high ceilings. Such a tower, however, would only accommodate shorter shaft sections, such as 4' length casings. A tower height at the high end of that range advantageously allows the use of longer shaft sections, such as 5' to 6' length casings, requiring fewer sections to be attached and removed during a grouting operation, for example, in comparison to a driver tool with a shorter tower.

Also shown in FIGS. 1A–B, the tower 120 is attached to the base plate 112. In addition to supporting the tower 120, the base plate 112 functions to supply stability and balance to the driver tool 100, advantageously requiring minimal support, if any, from the tool's operator. During operation, the base plate 112 is positioned flush against the ground, where its substantial weight and relatively large footprint provide a stable low center-of-gravity for the tool 100 and resistance to lateral movement. The large base plate footprint also prevents the tool from sinking into soft earth. A further base plate feature is an open-face slot 720 that accommodates shafts. This feature utilizes a shaft 710 (FIGS. 7A–C), such as an injection casing, to provide further driver tool stability. The open-face design also facilitates removing the driver tool from an installed shaft by simply moving the driver tool 100 away from the shaft 710 (FIGS. 7A–C) so that the shaft slides out of the open-face slot 720, eliminating the need to lift a heavy apparatus over the top of an installed shaft.

In one embodiment, the tower 120 is 9" wide and is attached to a base plate 112 constructed of 1" hot rolled steel having a 23" depth, 23" front width, 15½" back width and weighing about 90 lbs. The tower 120 can be constructed of 3/16" hot rolled steel having a 4" channel. A suitable hammer 130 is a Thor® 125 Breaker available from Champion Tool & Supply, Riverside, Calif., modified to replace the handle with a mounting bracket. Ignoring the open-face slot 720, the base plate 112 has an area of approximately 470 sq. in. The open-face slot 720 has a 7¾" length and a 3" width. The slot 720 ends in a semi-circular shape having a diameter matching the slot width. The dimensions of the open-face slot 720 advantageously accommodate 1½" schedule 80 injection casings having 2⅛" outer diameters. These casings are loose enough so that casings are easy to position within the driver tool 100, yet tight enough so that the casings provide support and stability to the tool.

Figure 2:
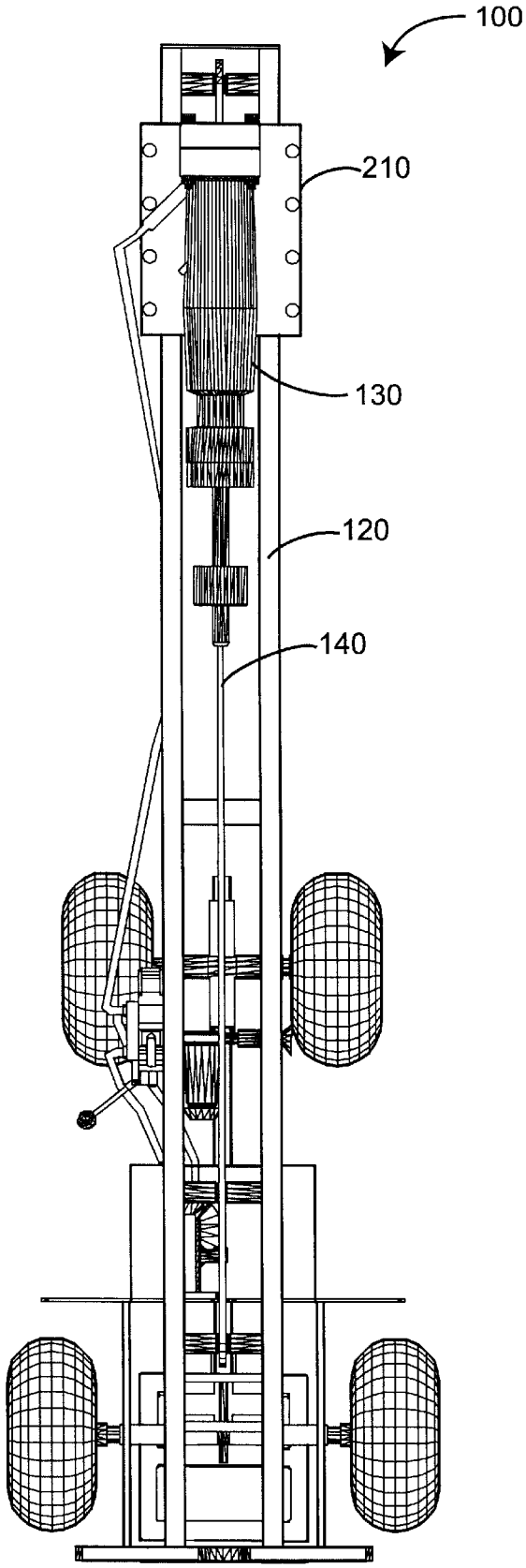
FIG. 2 is a front view of the driver tool illustrating its operating position with the hammer raised.

FIG. 2 also shows the driver tool 100 in its operating position. In contrast with FIGS. 1A–1B, the tool 100 is shown with the hammer 130 raised at its farthest extent along the tower 120. The tower 120 retains the drive chain 140 and a mounting plate 210. The mounting plate 210 is attached to the drive chain 140. The hammer 130 is attached to the mounting plate 210, which can slide along the length of the tower 120 as determined by movement of the drive chain 140. Note that a handle (not shown) may be attached to the mounting plate 210 so that an operator standing at the front of the driver tool 100 can further stabilize the driver tool 100 during operation.

Figure 3:
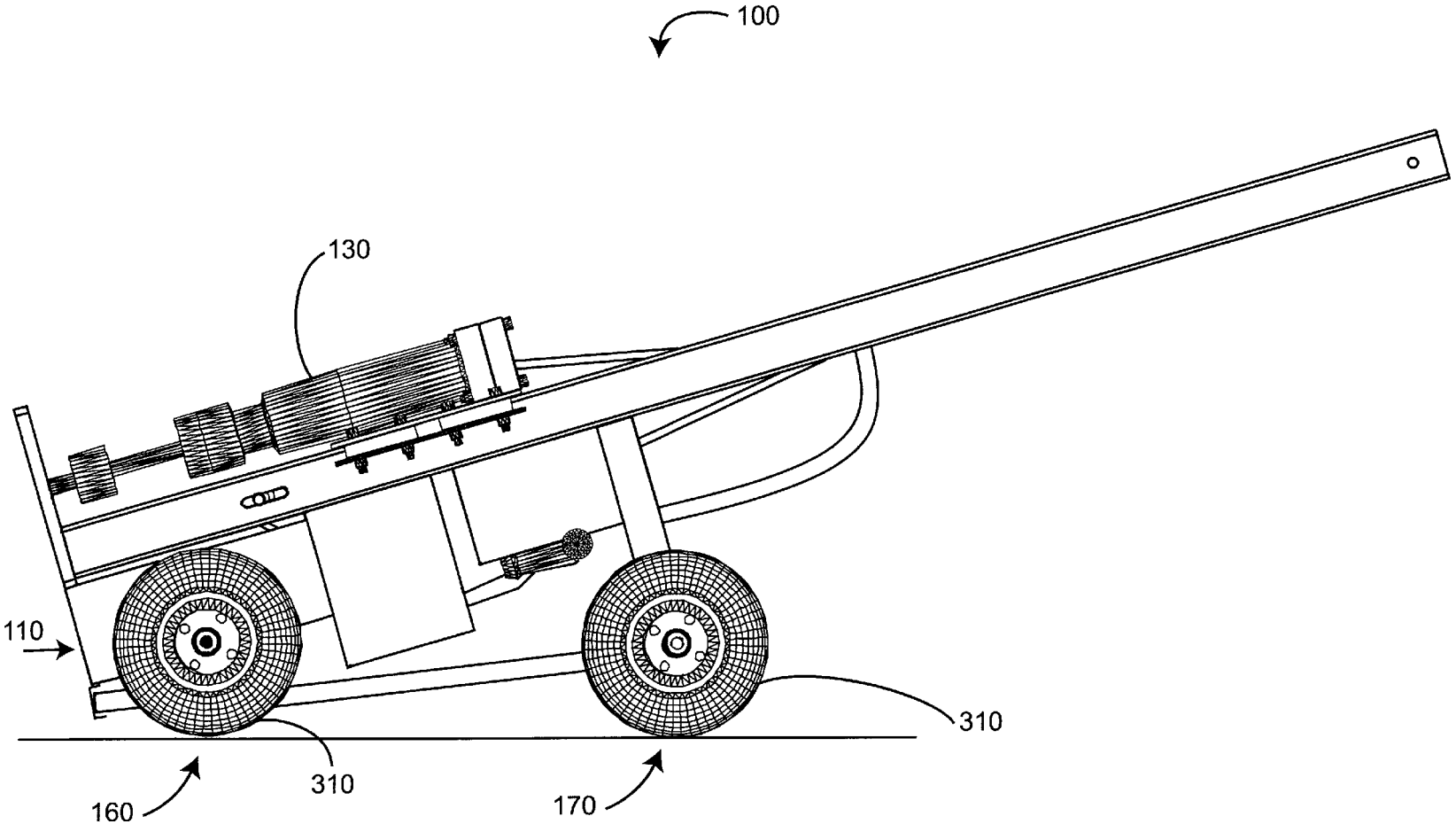
FIG. 3 is a side view of the driver tool illustrating its transport position.

FIG. 3 shows the driver tool 100 in its transport position. With the hammer 130 in its raised position (FIG. 2), the tool 100 is sufficiently balanced so that it can be moved from its operating position (FIG. 1A) to its transport position by one person. In the transport position, the tool is supported by turf tires 310 mounted on the front and rear wheel assemblies 160, 170. The front wheel assembly 160 has brakes (not shown) that, when set, prevent the front wheel assembly 160 from rotating. This facilitates moving the tool 100 between the transport and operating positions. Suitable tires 310 are sized 18.5"×8.5"×8", such as item number 1219-G051, available from Northern Hydraulics, Burnsville, Minn. The tires 310 are mounted on wheels and axles, which are available as an ATV Tire, Wheel, Hub and Axle Kit, item number 135012-G051, also from Northern. An attachment bracket (not shown) may be located on the tower 140 (FIGS. 1A–B) so that the driver tool 100 may be conveniently transported by a skipsteer loader or any tool with an excavating bucket attachment.

Figure 4:
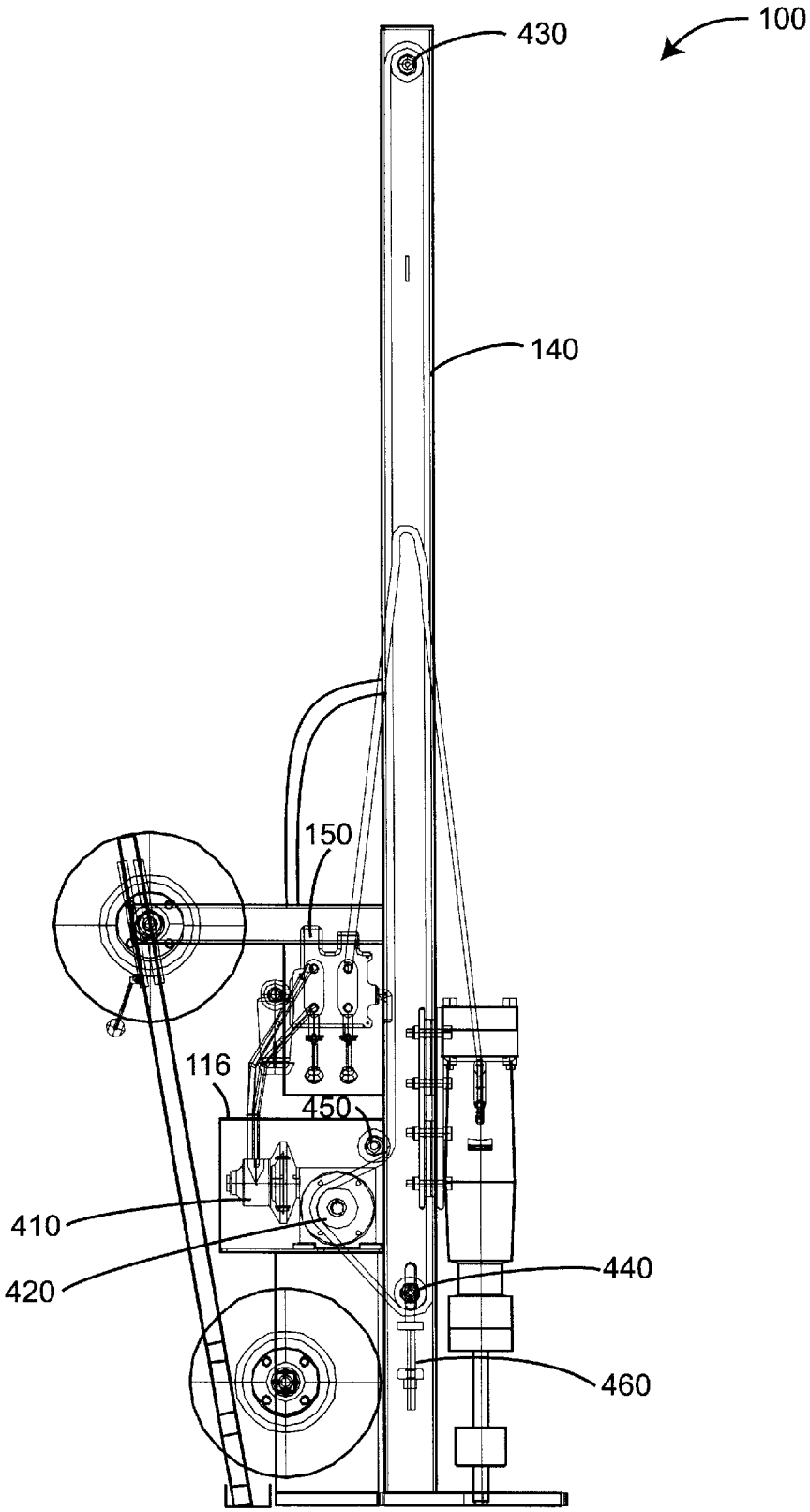
FIG. 4 is a side view of the driver tool illustrating the motor, gears and drive chain.

FIG. 4 shows the drive chain 140, the control assembly 150 and inside the motor box 116 revealing the motor 410 and the reduction gear 420. The drive chain 140 is shown engaged upon a combination of the reduction gear 420, an upper sprocket 430, a lower sprocket 440 and a motor box sprocket 450. The lower sprocket 440 is mounted to a tension adjuster 460 used to manually set the drive chain tension. The tension adjuster 460 may also advantageously incorporate a tension spring 590 (FIG. 5) to absorb mechanical force, such as vibration, that is otherwise transferred to the drive chain 140 during operation of the hammer 130.

One of ordinary skill in the art will recognize other linking mechanisms besides the drive chain 140 for transferring mechanical energy from the motor 410 to the hammer 130 in order to move the hammer 130 along the tower 120. For example, the mounting plate 210 could be threaded onto a jack screw that is installed within the tower 120 and rotated by the motor 410. As another example, the motor 410 could be installed on the mounting plate 210 with a geared drive shaft that engages teeth along the length of the tower 120.

Figure 5:
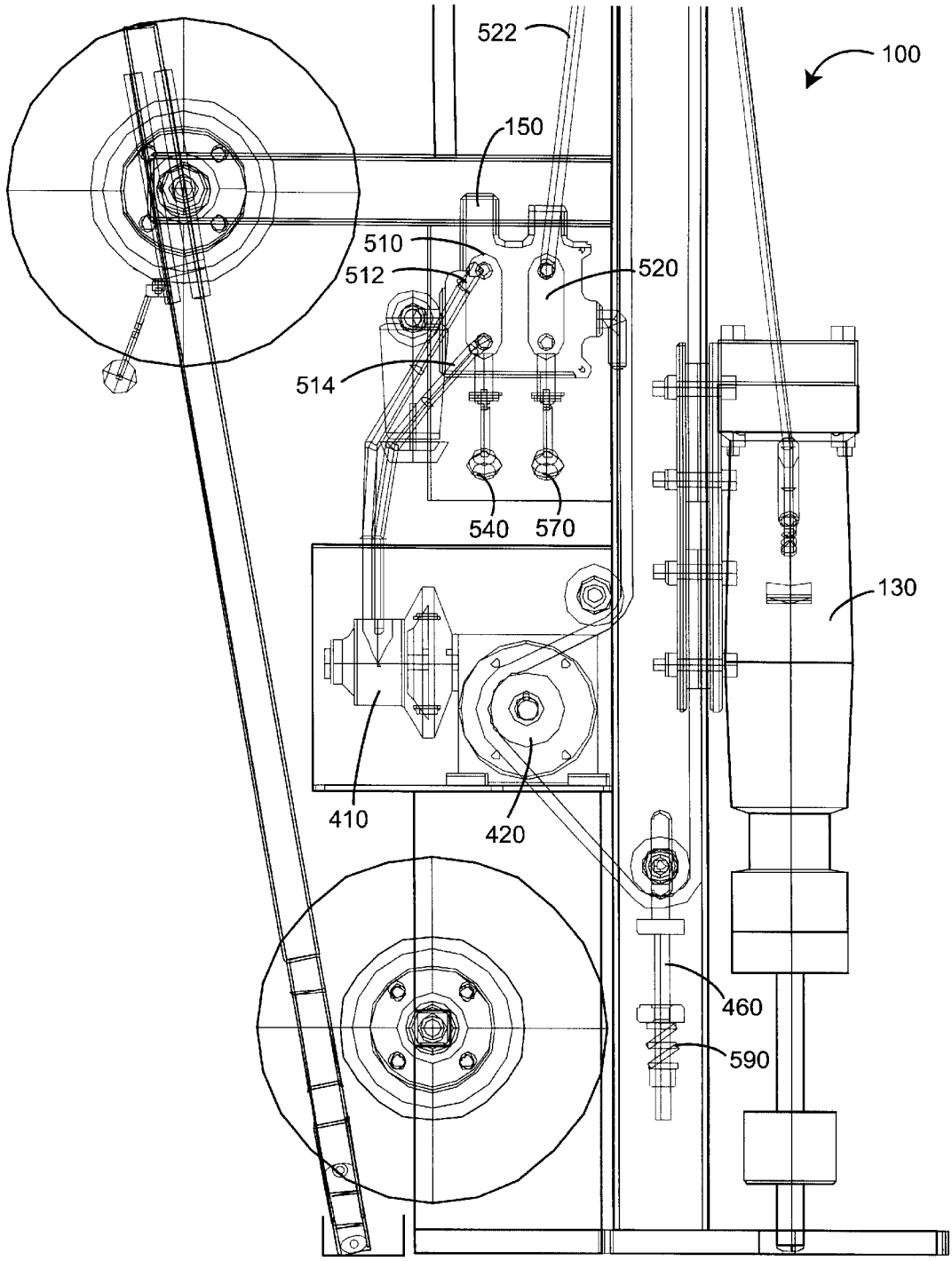
FIG. 5 is an expanded side view of the driver tool corresponding to FIG. 4.

FIG. 5 shows further detail of the control assembly 150 and the motor 410. The control assembly 150 has two valves, a dual-port valve 510 and a single-port valve 520. The dual-port valve 510 directs air pressure to either a first hose 512 or a second hose 514 as determined by the motor direction control handle 540. Pressure into the first hose 512 rotates the motor in a first direction, causing the gear 420 to turn counterclockwise and raising the hammer 130. Pressure into the second hose 514 rotates the motor in a second direction, causing the gear 420 to turn clockwise, lowering the hammer 130. The single-port valve 520 directs pressure into the hammer hose 522 as determined by the hammer control handle 570, actuating and de-actuating the hammer. Advantageously, pressing down simultaneously on both the motor direction control 540 and the hammer control 570 both lowers and actuates the hammer 130 so as to drive an injection casing into the ground at rate controllable by an operator using one hand. Power can be supplied to the driver tool 100 and in particular to the hammer 130 and the motor 410 by an external power unit or "mule" (not shown) that generates compressed air at a suitable pressure.

The reduction gear 420 has a gear ratio that provides a hammer movement slow enough for easy controllability and fast enough for reasonably quick shaft installation. In one embodiment, the reduction gear 420 has a gear ratio in the range of 50:1 to 70:1. A suitable reduction gear 420 is a model C70-HS gear box having a 60:1 gear ratio available from Toledo Gearmotor Company, Sylvania, Ohio. A suitable motor 410 is a model 4AM-NRV-570C air motor available from GAST Mfg. Inc., Benton Harbor, Mich. A suitable control assembly 150 is a model 201626-B938 4 way, 4 position 3500 psi direction control valve with spring center and float detent available from Prince Hydraulics, Sioux City, Iowa. Note that a two-way check vent (not shown) can be installed in the second hose 514 so that when the hammer is lowered, moisture can be vented to avoid accumulation in the motor.

Figure 6:
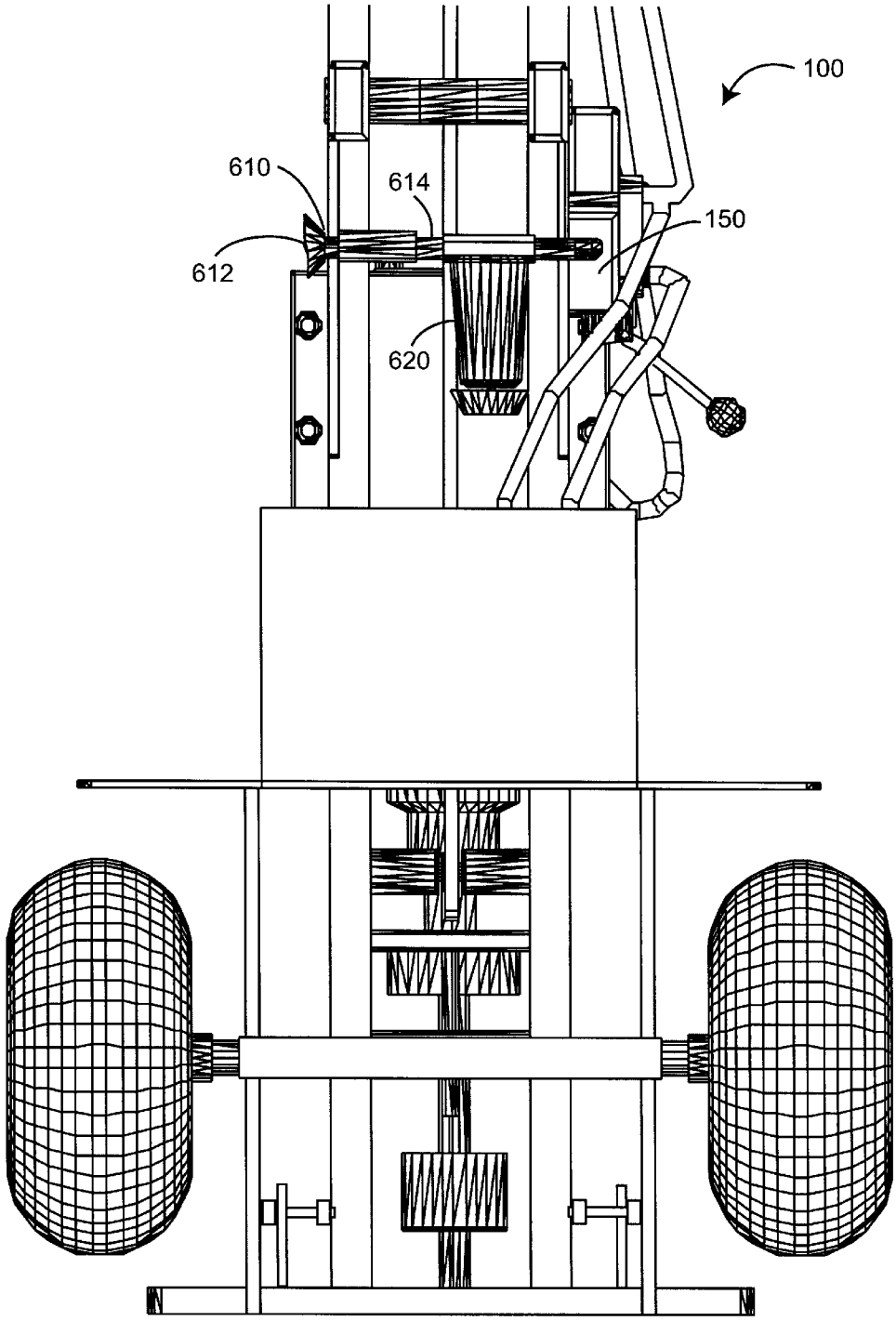
FIG. 6 is an expanded rear view of the driver tool illustrating the air filter and regulator.

FIG. 6 shows an air filter 610 and an air pressure regulator 620. Air pressure from a generator (not shown) is supplied via a hose connected to one end 612 of the air filter. The other end of the air filter 614 is attached to the regulator 620. In turn, the regulator 620 supplies a lowered, controlled air pressure to the control assembly 150.

Although the above embodiments are described in terms of a pneumatic hammer and motor, one of ordinary skill in the art will recognize that the drive tool 100 and in particular the hammer 130 and the motor 410 can be configured to operate from other externally generated power sources, such as pressurized hydraulic fluid or electricity. Alternatively, the drive tool 100 can be internally powered by a fuel, such as a gasoline motor to move or actuate the hammer 130.

Figure 7C:
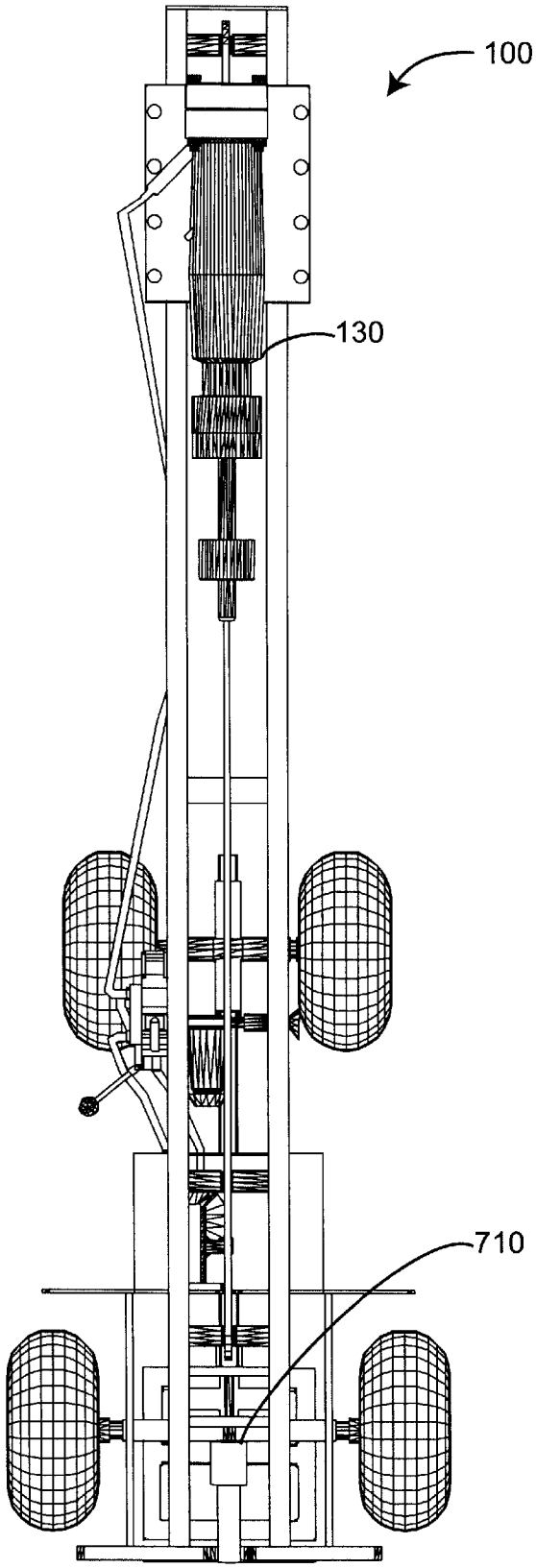
FIG. 7C is a front view of the driver tool illustrating an installed casing and the hammer in its fully raised position for attachment of another injection casing section.

FIGS. 7A–C illustrate operation of the driver tool 100. FIG. 7A shows the tool 100 with the hammer 130 in a fully raised position. A shaft 710 is accommodated within the open-face slot 113 of the base plate 112. A bit 730 is attached to the hammer 130 and positioned at one end 712 of the shaft 710. A suitable bit 730 for use in driving injection casings is a one-piece pipe driver having a 1⅛" or 1¼" shank and a tip that fits within 1½" casings, available from Vulcan Tools, South Hingham, Mass. The brace 114 is deployed to support the tool 110 against the ground in conjunction with the base plate 112. FIG. 7B shows the hammer 130 in a partially lowered position after the control valves 540, 570 are pushed down to actuate and lower the hammer 130, driving the injection casing 710 into the ground. FIG. 7C shows the hammer 130 in a fully raised position so that another section of injection casing may be attached to the protruding end of the previously installed casing 710.

The portable injection-casing driver has been disclosed in detail in connection with various embodiments of the present invention. These embodiments are disclosed by way of examples only and are not to limit the scope of the present invention, which is defined by the claims that follow. One of ordinary skill in the art will appreciate many variations and rodifications-within the scope of this invention.

What is claimed is:

1. A driver tool for hammering a shaft into a surrounding media comprising:

a base plate;

a tower attached to and extending generally perpendicularly from said base plate, said tower having a first end distal said base plate and a second end proximate said base plate;

a powered hammer movable along said tower between said first and second ends so that shaft can be positioned between said media and said hammer when said hammer is proximate said first end and so that said shaft can be driven by said hammer into said media as said hammer is actuated and moved toward said second end;

a motor;

a mount retained by said tower so as to be movable along said tower, said hammer attached to said mount; and a link installed between said tower first and second ends utilized to transfer mechanical energy from said motor to said mount so as to move said hammer, wherein said link comprises an upper sprocket proximate said first end, a lower sprocket proximate said second end, a reduction gear and a drive chain engaging said sprockets and said gear, said motor engaging said gear.

2. The diver tool according to claim 1 wherein at least one of said sprockets has a spring-loaded tension adjuster configured to dampen mechanical force generated during operation of said hammer.

3. The driver tool according to claim 1 wherein said reduction gear has a gear ratio in the range of 50:1 to 70:0.

4. The driver tool according to claim 1 further comprising a control assembly having a first portion to direct power to said motor in order to raise and lower said hammer, and a second portion to direct power to said hammer in order to actuate and de-actuate said hammer, said first portion and said second portion independently operable and configured to allow an operater to simultaneously lower and actuate said hammer with one hand.

5. The driver tool according to claim 4 wherein said motor and said hammer are powered by compressed air and said first portion comprises a dual-port valve controlled by a first handle to direct compressed air through said motor and said second portion comprises a single-port value controlled by a second handle to direct compressed air to said hammer.

6. The driver tool according to claim 1 wherein said base plate has an open-faced slot configured to accommodate said shaft and stabilize said tool.

7. The driver tool according to claim 1 wherein said tower has a height in the range of 94 inches to 116 inches.

8. The driver tool according to claim 1 further comprising a wheel assembly, said tool being movable between an operating position having said base plate positioned against said media and a transport position having said wheel assembly position against said media so as to provide manual portability for said tool.

9. The driver tool according to claim 8, wherein said wheel assembly is offset from said media in said operating position so as to increase stability for said tool and said base plate is offset from said media in said transport position so as to increase portability of said tool.

10. The driver tool according to claim 8 further comprising a brace that,is deployed in said operating position to enhance the stability of said tool and that is folded against said tool is said transport position to enhance the portability of said tool.

11. A driver tool for installing a shaft into a media comprising:

a base means for supporting said tool and accommodating said shaft;

a hammer means for repeatedly striking said shaft;

a tower means attached to said base means for movably retaining said hammer means;

a motor;

a positioning means actuated by said motor for moving said hammer means along said tower means; and a control means for independently routing power to said hammer means and said motor.

12. The driver tool according to claim 11 further comprising a transport means for manually moving said tool.

13. A driver tool comprising:

a tower extending between a first end and a second end;

a hammer movable along said tower;

a base plate attached to said second end; and a wheel assembly offset from a media in a tool operating position, said tower stabilized by said base plate against said media in said operating position, said wheel assembly positioned against said media in a tool transport position.

14. The driver tool according to claim 13 further comprising an open-face slot defined by said base plate and adapted to accommodate a shaft and slidably release said shaft by moving said tool.

15. The driver tool according to claim 13 further comprising:

a motor; and a reduction gear coupled to said motor and linked to said hammer so as to provide controllable hammer movement.

16. The driver tool according to claim 13 further comprising a control assembly adapted to direct power to said hammer, said control assembly having a first handle configured to move said hammer along said tower and a second handle configured to actuate said hammer, said handles positioned so as to be operable with one hand.

17. The driver tool according to claim 13 further comprising:

a motor;

a link between said motor and said hammer so as to raise and lower said hammer along said tower; and a tension adjuster coupled to said link so as to dampen mechanical force generated during operation of said hammer.

18. The driver tool according to claim 13 further comprising:

a handle configured to allow a person to move said tool between said tool operating position and said tool transport position; and a brace having a retracted position corresponding to said tool transport position and a deployed position against said media corresponding to said tool operating position.

* * * * *